US007412811B2

(12) United States Patent
Marcus et al.

(10) Patent No.: US 7,412,811 B2
(45) Date of Patent: Aug. 19, 2008

(54) MULTIFLOW GASSING SYSTEM

(75) Inventors: Frank F. Marcus, Lake In The Hills, IL (US); James J. Sanfilippo, Barrington Hills, IL (US); John E. Sanfilippo, Barrington Hills, IL (US)

(73) Assignee: Packaging Technologies, Inc., Davenport, IA (US)

( * ) Notice: Subject to any disclaimer, the term of this patent is extended or adjusted under 35 U.S.C. 154(b) by 24 days.

(21) Appl. No.: 11/405,077

(22) Filed: Apr. 17, 2006

(65) Prior Publication Data

US 2006/0254217 A1 Nov. 16, 2006

Related U.S. Application Data

(60) Provisional application No. 60/672,137, filed on Apr. 15, 2005.

(51) Int. Cl.
*B65B 31/04* (2006.01)
*A61L 2/20* (2006.01)

(52) U.S. Cl. ..... 53/432; 53/510; 141/4; 422/33; 422/302

(58) Field of Classification Search ..... 53/403, 53/432, 485, 79, 510, 290; 141/4, 5, 48, 141/54; 422/33, 302, 304
See application file for complete search history.

(56) References Cited

U.S. PATENT DOCUMENTS 2,184,490 A * 12/1939 Lauve et al. ..... 53/407
2,518,856 A * 8/1950 Bell ..... 53/406
2,518,857 A * 8/1950 Bell ..... 53/79
2,917,880 A * 12/1959 Hohl ..... 53/79
3,365,856 A * 1/1968 Harmon ..... 53/490
4,140,159 A * 2/1979 Domke ..... 141/129
4,602,473 A * 7/1986 Hayashi et al. ..... 53/510
4,658,566 A 4/1987 Sanfilippo
4,791,775 A * 12/1988 Raque et al. ..... 53/510
4,905,454 A 3/1990 Sanfilippo et al.
5,001,878 A 3/1991 Sanfilippo et al.
5,069,020 A 12/1991 Sanfilippo et al.
5,228,269 A 7/1993 Sanfilippo et al.
5,417,255 A 5/1995 Sanfilippo et al.
5,617,705 A 4/1997 Sanfilippo et al.
5,816,024 A 10/1998 Sanfilippo et al.

(Continued)

OTHER PUBLICATIONS

U.S. Appl. No. 11/368,236, filed Mar. 3, 2006, Sanfilippo et al.

(Continued)

*Primary Examiner*—Louis K. Huynh
*Assistant Examiner*—Paul Durand
(74) *Attorney, Agent, or Firm*—Wood, Herron & Evans, LLP

(57) ABSTRACT

A multiflow gassing system for providing controlled environment gas to a lid and container, the system including a lid carrier; and a gas rail assembly adjacent the lid carrier, the gas rail assembly having a top portion including a top portion gas outlet, an end portion including a end portion gas outlet, and a plate adjacent the end portion. The top portion gas outlet is oriented to direct the controlled environment gas into the lid and the end portion gas outlet is oriented to direct the controlled environment gas into a lid-container engagement region.

20 Claims, 10 Drawing Sheets

U.S. PATENT DOCUMENTS

| | | | | |
|---|---|---|---|---|
| 5,911,249 | A | 6/1999 | Sanfilippo et al. | |
| 5,916,110 | A | 6/1999 | Sanfilippo et al. | |
| 5,918,616 | A | 7/1999 | Sanfilippo et al. | |
| 5,961,000 | A | 10/1999 | Sanfilippo et al. | |
| 5,981,897 | A | 11/1999 | Offer et al. | |
| 6,032,438 | A | 3/2000 | Sanfilippo et al. | |
| 6,221,411 | B1 | 4/2001 | Sanfilippo et al. | |
| 6,691,747 | B1 | 2/2004 | Marcus et al. | |
| 7,040,075 | B2 * | 5/2006 | Seebeger et al. | 53/432 |
| 2004/0084087 | A1 | 5/2004 | Sanfilippo et al. | |
| 2004/0163586 | A1 * | 8/2004 | Sanders et al. | 118/68 |
| 2006/0022068 | A1 | 2/2006 | Sanfilippo et al. | |

OTHER PUBLICATIONS

U.S. Appl. No. 11/170,368, filed Jun. 29, 2005, Sanfilippo et al.
U.S. Appl. No. 11/405,227, filed Apr. 17, 2006, Marcus et al.

* cited by examiner

MULTIFLOW GASSING SYSTEM

CROSS-REFERENCE TO RELATED APPLICATION

This application claims priority to U.S. Provisional Patent Application No. 60/672,137, filed on Apr. 15, 2005, and incorporated herein by reference.

FIELD OF THE INVENTION

The invention relates to an apparatus for exposing containers and container covers to a controlled environment. More particularly, this invention relates to a multiflow gassing system.

BACKGROUND OF THE INVENTION

Various products including food products, semiconductor products, medical products, and any other products that have an adverse reaction to air, are packaged in a controlled environment. Because even a small amount of air can seriously damage the product or decrease its shelf life, various attempts have been made to efficiently package these products in controlled environments using vacuum and/or controlled environment gas.

Gassing rail systems have been utilized as one way to remove air from product containers. Products in open top containers are carried, along rails, by a conveyor belt in a direction of movement. A gas flushing device directly above the rail supplies controlled environment gas to the container beneath it.

However, there are problems in providing a controlled environment atmosphere when two parts, such as a bottle and a cap, must be joined to seal the enclosure of the product. It is often difficult to maintain a controlled environment atmosphere in the bottle and the cap until the portions are joined. Various machines must be employed to flush the bottles and caps as they move along high speed production lines. Often, in the time that the bottle and cap leave the gassing machines and are joined, their controlled environment atmosphere is diluted by entering air.

It would, therefore, be desirable to have a gassing system that overcomes the above disadvantages.

SUMMARY OF THE INVENTION

One aspect of the invention provides a system for providing controlled environment gas to a lid and container, the system including a lid carrier; a gas rail assembly adjacent the lid carrier, the gas rail assembly having a top portion including a top portion gas outlet and an end portion including a end portion gas outlet; and a plate adjacent the end portion. The top portion gas outlet is oriented to direct the controlled environment gas into the lid and the end portion gas outlet is oriented to direct the controlled environment gas into a lid-container engagement region.

Another aspect of the invention provides a method of providing controlled environment gas to a lid and container, the method including flowing the controlled environment gas into a lid passing along a lid carrier; and flowing the controlled environment gas past a plate into a lid-container engagement region.

Another aspect of the invention provides a system for providing controlled environment gas to a lid and container, the system including means for flowing the controlled environment gas into a lid passing along a lid carrier; and means for flowing the controlled environment gas past a plate into a lid-container engagement region.

The foregoing and other features and advantages of the invention will become further apparent from the following detailed description of the presently preferred embodiment, read in conjunction with the accompanying drawings. The drawings are not to scale. The detailed description and drawings are merely illustrative of the invention rather than limiting, the scope of the invention being defined by the appended claims and equivalents thereof.

BRIEF DESCRIPTION OF THE DRAWINGS

Throughout the various figures, like reference numbers refer to like elements.

DETAILED DESCRIPTION OF PRESENTLY PREFERRED EMBODIMENTS

Figure 1:
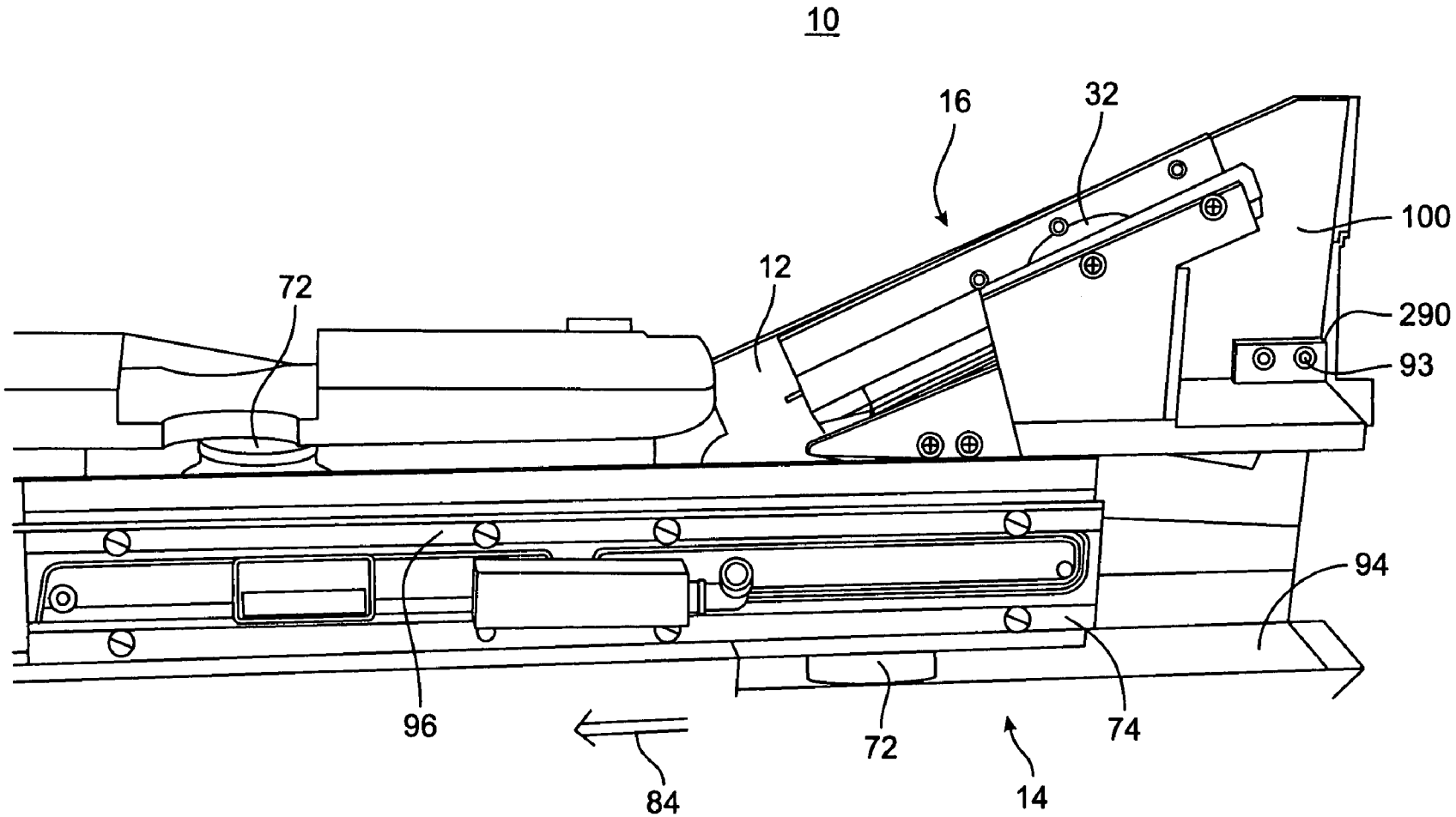
FIGS. 1-6 is a side view of a multiflow gassing system in accordance with one embodiment of the present invention.

FIGS. 1-5 illustrate one embodiment of a multiflow gassing system 10. FIG. 1 shows perspective view of a multiflow gassing system 10, in accordance with the present invention. Multiflow gassing system 10 includes gas rail assembly 12, container transport assembly 14 and lid transport assembly 16. Lid transport assembly 16 is positioned substantially above gas rail assembly 12 and container transport assembly 14 is positioned substantially below gas rail assembly 12 such that during operation a lid will meet with a container as described in more detail below.

Figure 2:
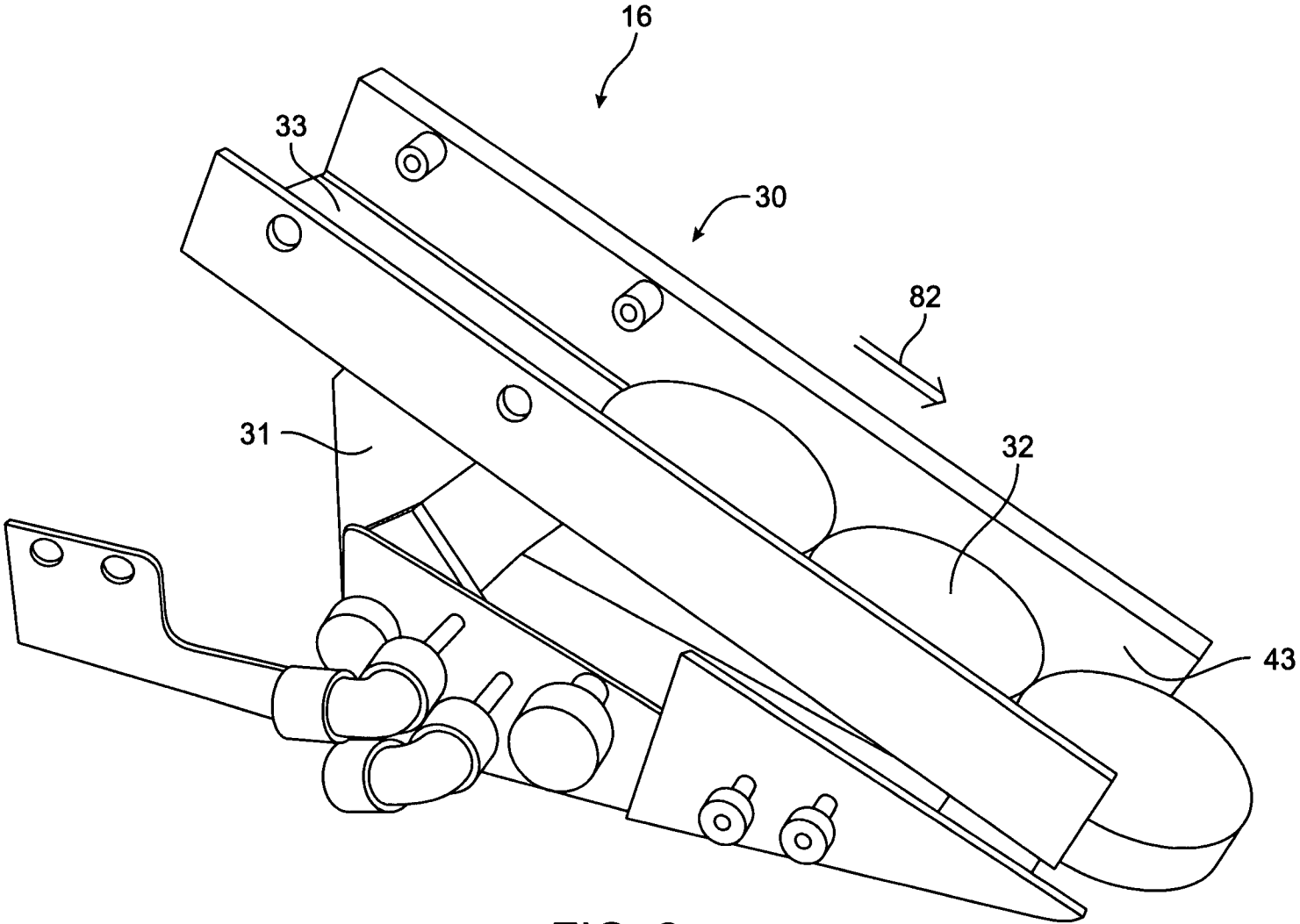
Figure 3:
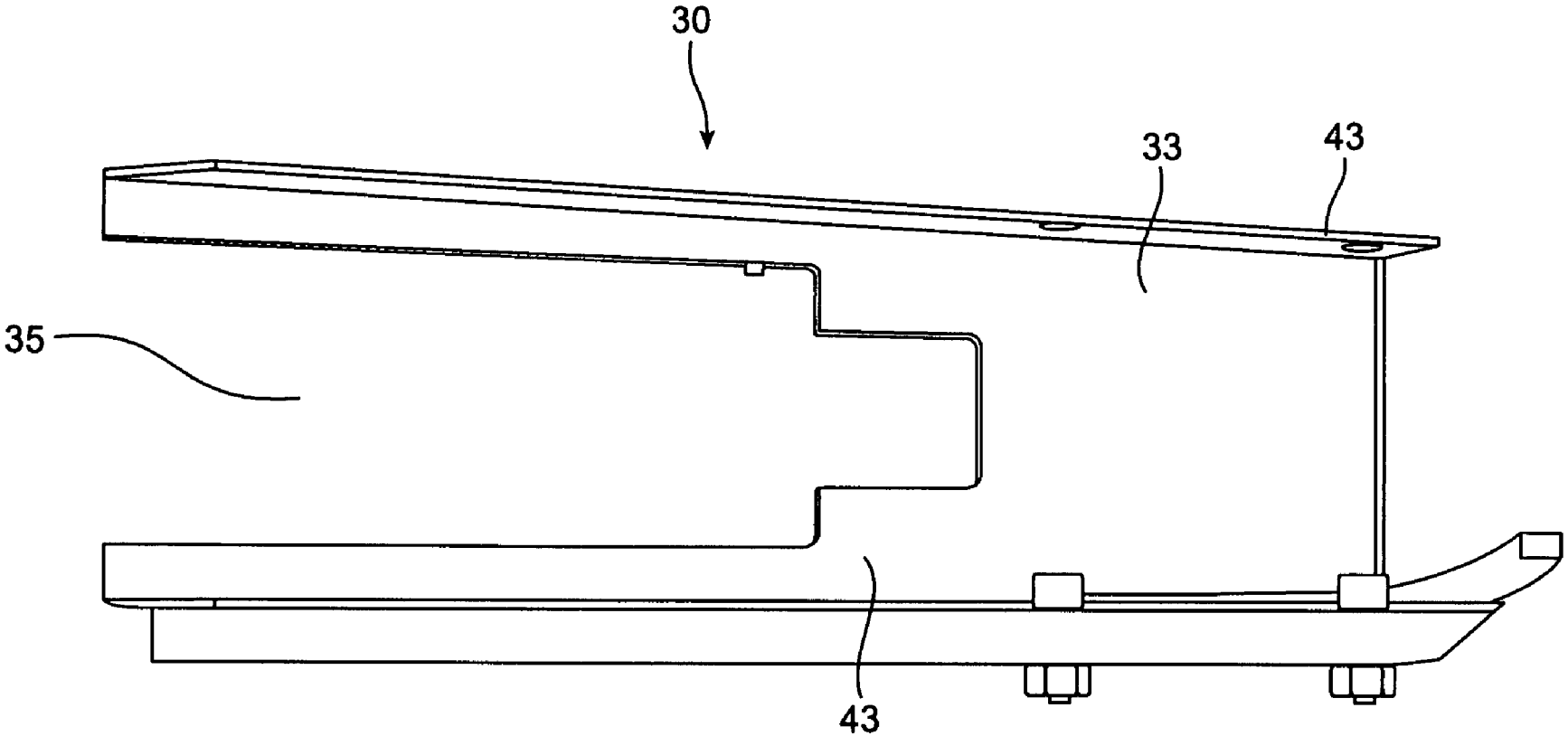

FIGS. 2 and 3 illustrate one embodiment of lid transport assembly 16. Lid transport assembly 16 is composed of materials such as, for example, stainless steel and rigid polymers as are known in the art. Lid transport assembly 16 includes lid carrier 30 and support 31. Lid carrier 30 comprises a base portion 33 and side rails 43. A lid carrier 30 is positioned above the top portion of gas rail housing 18. Lids 32 travel along lid carrier 30 in a direction of movement indicated by arrow 82.

In one embodiment illustrated in FIG. 3, base portion 33 of lid carrier 30 includes an opening 35 along a portion of the length of base portion 33. Opening 35 substantially corresponds to gas flow openings of gas rail assembly 12, discussed in more detail below. Those with skill in the art will recognize that base portion 33 and opening 35 may take many different configurations for allowing gas to reach the underside of the lids as the lids travel along the base toward the container. For example, in another embodiment, lid carrier 30 comprises a base portion 33 having a plurality of openings thereby forming a porous slide. In another example, lid carrier 30 comprises any suitable carrier such as, for example, a porous conveyer.

Support 31 is fixedly attached to lid carrier 30 and may include fasteners (not shown) for removeably fastening lid carrier 30 to gas rail assembly 12. In one embodiment, support 31 may be configured to be adjustable to allow for a change in the slope of the lid carrier 30 relative to gas rail assembly 12. Those skilled in the art will appreciate that the lid carrier is not limited to the exemplary lid carrier 30 as illustrated in FIG. 3. As defined herein, the lid carrier can be any device providing a lid to a lid-container engagement region. For example, the lid carrier can be a mechanical device that picks up individual lids and delivers them to the lid-container engagement region. In another example, the lid carrier can be a rotary device feeding the lids into the lid-container engagement region.

In another embodiment, lid transport assembly 16 is absent from multiflow gassing system 10 and, instead, lids 32 move directly along the top portion 22 of gas rail assembly 12.

Referring again to FIG. 1, container transport assembly 14 comprises a conveyor 94 positioned to transport an open container 72 into contact with a lid 32 traveling along lid carrier 30. One or more containers 72 travel along conveyer 94 in a direction of movement indicated by arrow 84. Conveyors are well known to those with skill in the art. Container transport assembly 14 may also include a side rail 74. Side rail 74 may be positioned to prevent containers from falling off conveyor 94. In one embodiment, side rail 94 may also include a gassing rail 96. Gassing rail 96 may be positioned to provide a blanket of controlled environment gas to and around container 72 as it travels along conveyor 94. Gassing rail 96 may be any type of gassing rail suitable for providing a controlled environment, and are well known to those with skill in the art.

Figure 4:
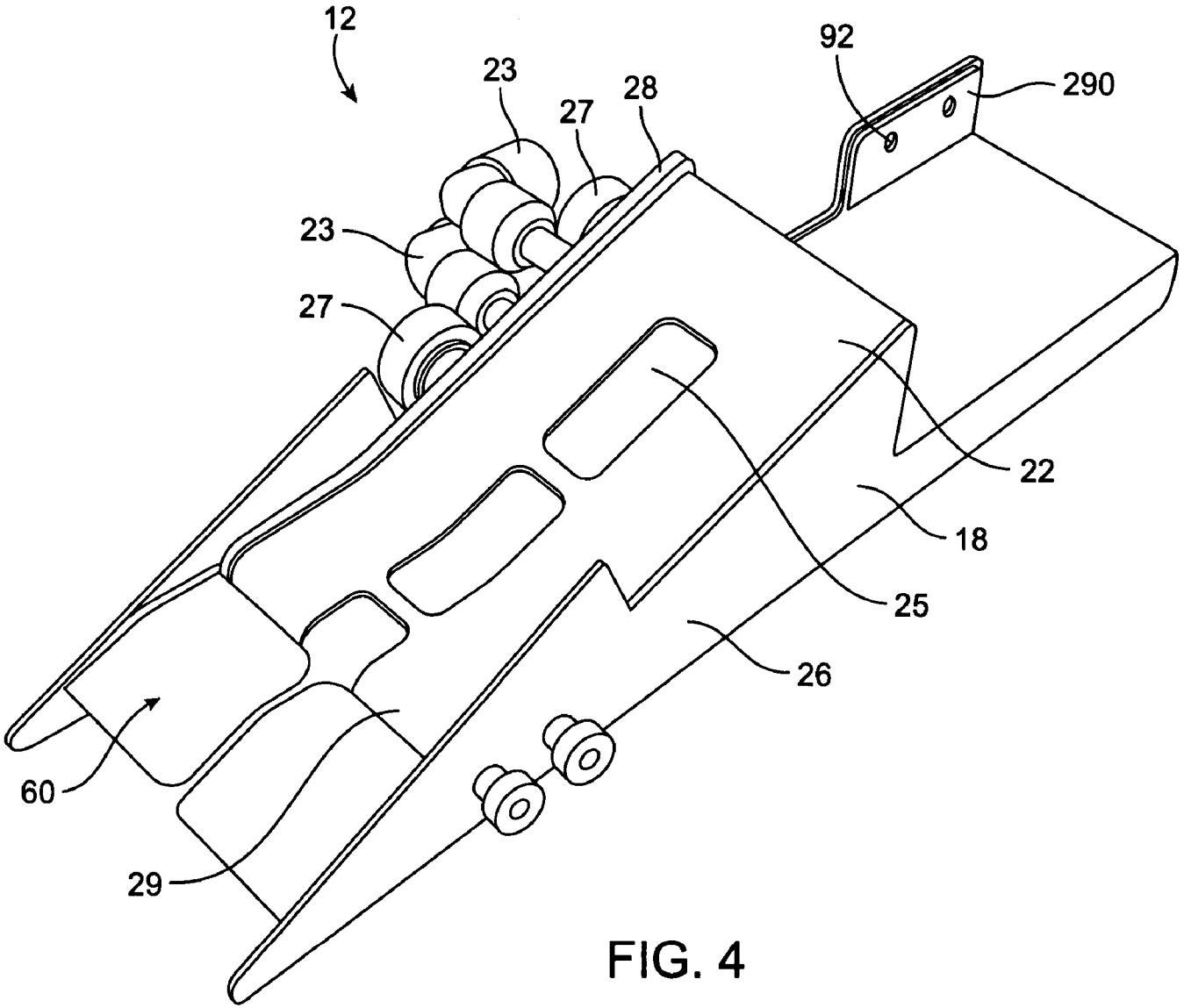
Figure 5:
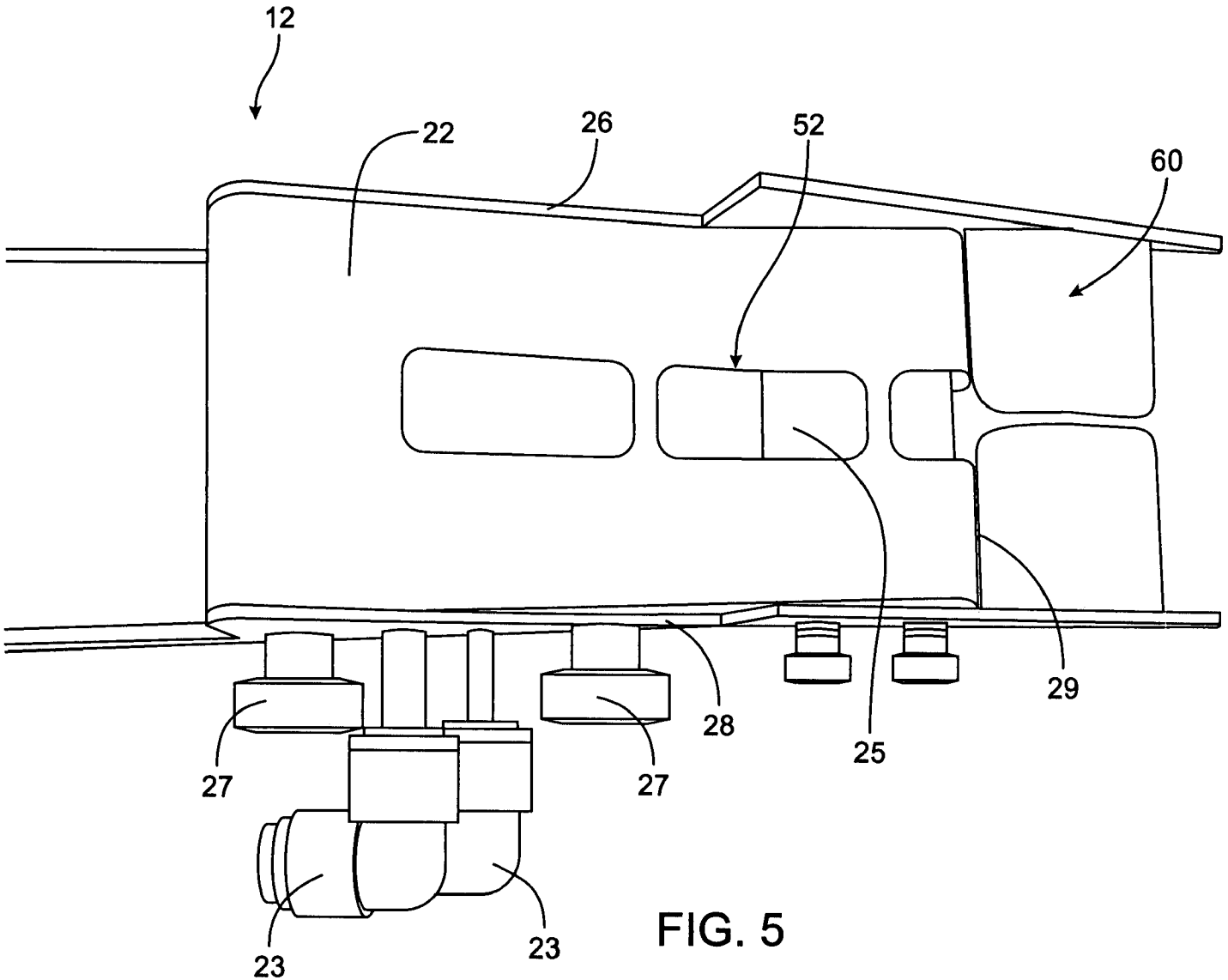
Figure 6:
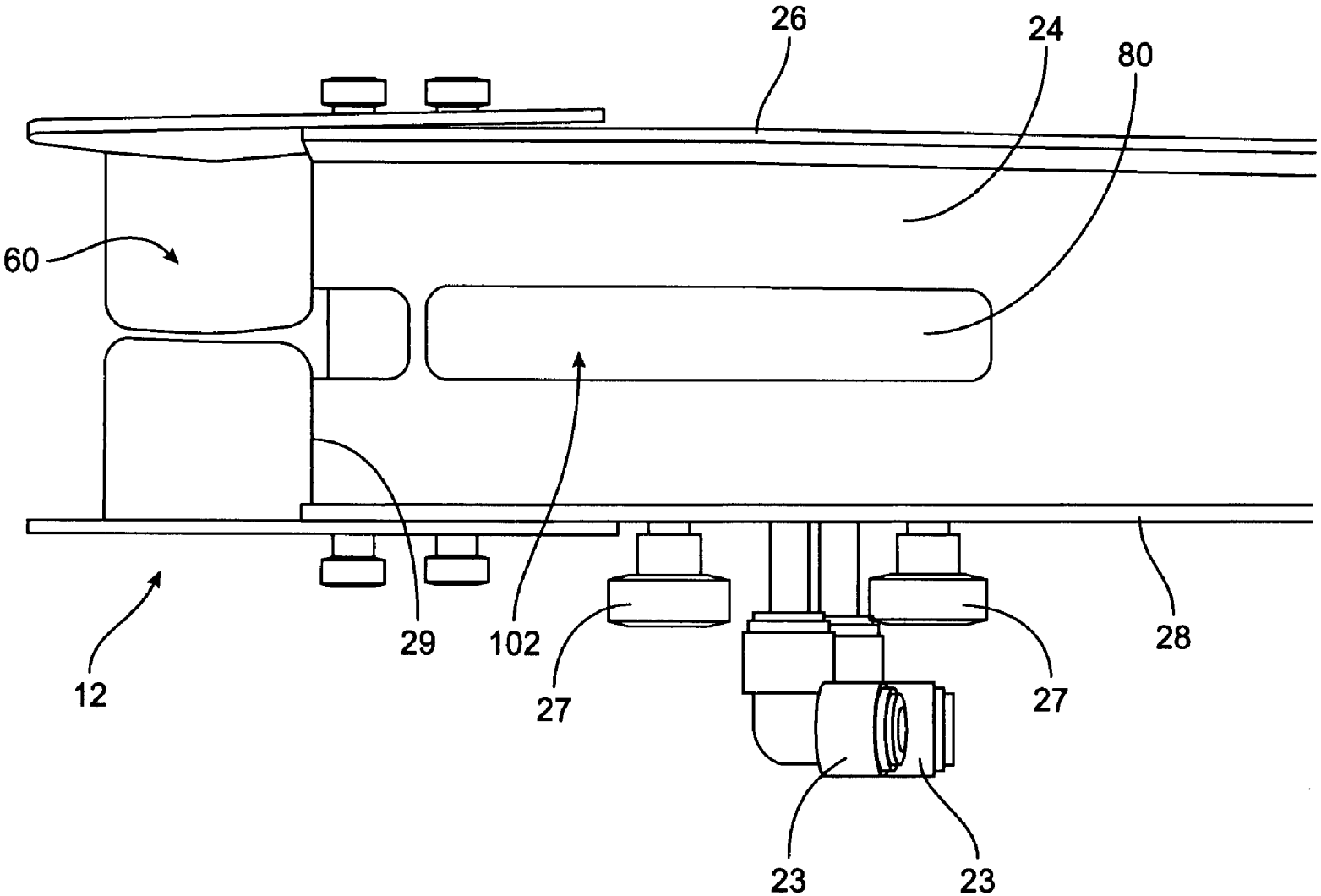

FIGS. 4 to 6 illustrate one embodiment of gas rail assembly 12. FIG. 4 shows a perspective view of gas rail assembly 12, FIG. 5 shows a top view of gas rail assembly 12 and FIG. 6 shows a bottom view of gas rail assembly 12. The gas rail assembly 12 provides controlled environment gas for gassing product containers 72 and product container covers such as lids 32. Gas rail assembly 12 includes gas rail housing 18, at least one gassing element 25 and targeted gassing assembly 60.

Gas rail assembly 12 can be mounted on a support 100 (FIG. 1) via mounting bracket 290. In one example, mounting bracket 290 has openings 92 through which bracket fasteners 93 (FIG. 1) can be positioned to secure gas rail assembly 12 to support 100. Bracket fastener 93 may be, for example, a screw, bolt, clip, or other suitable fastener. Alternatively, gas rail assembly 12 may be mounted to a support 100 by welding or riveting.

Gas rail housing 18 includes top portion 22, bottom portion 24, end portion 29 and sides 26, 28. Gas rail housing 18 components 22, 24, 26 and 28 combine to form an internal plenum, such as a wedge shaped plenum, for receiving controlled environment gas. Controlled environment gas enters plenum via one or more gas inlets 23. In one embodiment, the plenum is divided into more than one plenum, each supplied by a separate gas inlet. The individual gas inlets can be supplied with different controlled environment gases to provide different controlled environment gases from different parts of the gas rail housing 18, such as from top portion 22 and bottom portion 24, or the same gas at different pressures to provide different gas flow rates from each plenum. Gas inlet 23 comprises any suitable opening or structure to allow controlled environment gas to flow into the plenum. In one example, gas inlet 23 comprises a hose attached to an inlet opening in the side of gas rail housing 18. In another example, gas inlet 23 comprises a gas tap with a gas flow control valve attached to an inlet opening in the side of gas rail housing 18. Controlled environment gas is any suitable gas that can be placed into containers and/or lids. In one example the gas is selected from nitrogen, oxygen, carbon dioxide, argon, steam, an inert gas, or the like. Those skilled in the art will appreciate that the gas can be selected as desired for the particular application.

In one embodiment, one or both of sides 26, 28 may be removed from gas rail housing 18. Housing sides 26 and/or 28 may be removed to gain access to the interior of gas rail housing 18 for such activities as maintenance and cleaning. In this embodiment, one or more side fasteners 27 secure at least one removable side of gas rail housing 18. In one example, unfastening of one or more side fasteners 27 allows removal of the side 28 containing gas inlets 23. Side fastener 27 can be any fastener such as a screw, bolt, clip, mounting flap, or any other suitable device to secure the sides 26, 28 of gas rail housing 18.

Gas rail housing 18 is constructed of a rigid material, such as nylon, stainless steel, or plastic, that prevents gas flow in and out of plenum except through the designated gas inlets 23 and gas elements 25, 80 described below. In one embodiment, gas rail housing 18 contains various seal members such as O-rings and gaskets positioned around its perimeter and around inlet openings and fastener holes, to further prevent escape of controlled environment gas.

In one embodiment, gas rail housing 18 has the shape of a three-dimensional wedge. In other embodiments, the shape of gas rail housing 18 may be determined by the angle between container conveyer 94 and lid carrier 30. Any suitable angle can be chosen to allow lid 32 to travel on lid carrier 30 to meet with container 72 traveling on conveyer 94. Either the lid carrier 30 can be angled in respect to a horizontally positioned conveyer 94, or the conveyer 94 can be angled in respect to a horizontally positioned lid carrier 30. In one example, the projected angle between container conveyer 94 and lid carrier 30 comprises 45 degrees. Alternatively, both lid carrier 30 and conveyer 94 are each angled in respect to a horizontal plane.

Referring to FIG. 5, top portion 22 of gas rail housing 18 includes at least one gas outlet 52. A gassing element 25 is disposed within gas rail housing 18 adjacent gas outlets 52. Gassing element 25 may comprise a laminar screen, a dual flow laminar screen or a gas manifold as are well known in the art. Those skilled in the art will appreciate that the type of gassing element 25 can be selected for the particular application. The gassing element 25 can be a distribution manifold as described in U.S. Pat. No. 5,417,255 to Sanfilippo, et al., entitled Gas Flushing Apparatus and Method, incorporated herein in its entirety by reference.

In operation, controlled environment gas flows from plenum through gassing element 25 and out gas outlet 52 to bathe the underneath side of the lids 32 as the lids travel along opening 35 of lid carrier 30. The controlled environment gas directed out of gas outlets 52 replaces the air underneath and surrounding lid 32 with controlled environment gas.

Those with skill in the art will recognize that the configuration of gas element 25 and gas outlet 52 may vary depending on the specific application. For example, in one embodiment, a series of gas outlets 52 are located in the top portion 22 of gas rail housing 18. In another example, one elongated gas outlet 52 is positioned in the top portion 22 of gas rail housing 18.

Referring to FIG. 6, FIG. 6 is a bottom view of the gas rail assembly 12 showing bottom portion 24 of gas rail housing 18. Bottom portion 24 of gas rail housing 18 includes gas outlet 102 and gassing elements 80 similar to or the same as those of gas element 25 located at the top portion 22 of gas rail housing 18. Gassing element 80 may comprise a laminar screen, a dual flow laminar screen or a gas manifold as are well known in the art. Container gassing element 80 gasses a container 72 with controlled environment gas from the plenum as container 72 travels along conveyer 94.

In one embodiment having a dual flow laminar screen, controlled environment gas has a relatively high velocity sufficient to carry the gas into a container 72 and/or into the underside of lid 32. After reaching the product in the container 72 or underside of lid 32, the flow pattern of the controlled environment gas may gradually change direction and flows out of container 72 or lid 32. Controlled environment gas passing through adjacent regions of higher flow resistance has a lower velocity than the gas flowing through the center region of lower flow resistance and may be partially carried into container 72 or lid 32. This lower velocity flow of gas creates a blanket of gas surrounding the higher velocity flow of gas to prevent the inflow of air into the stream of high velocity gas flow.

Figure 7:
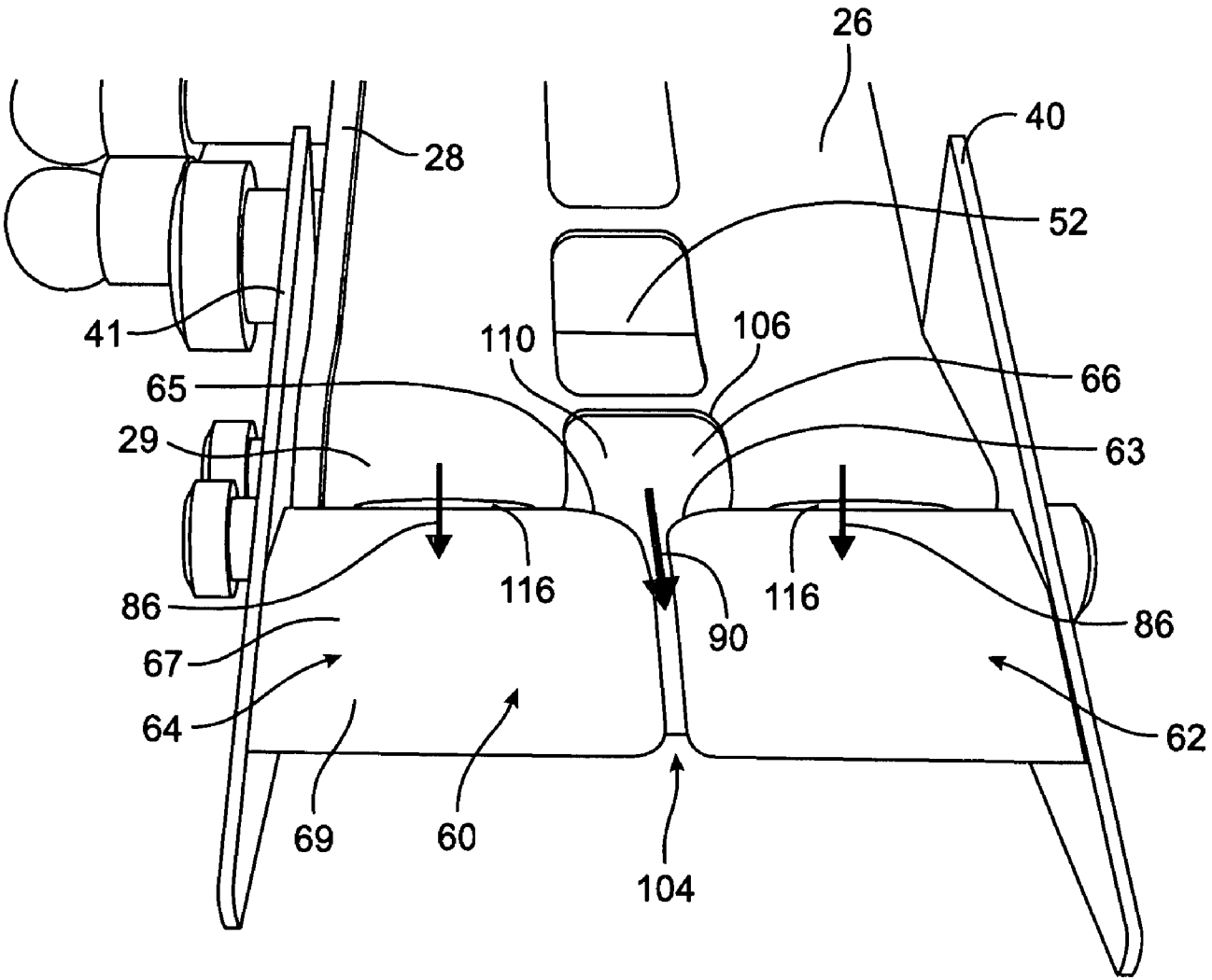
FIG. 7 is an enlarged bottom view, at a Venturi device, of the multiflow gassing system in accordance with one embodiment of the present invention.
Figure 8:
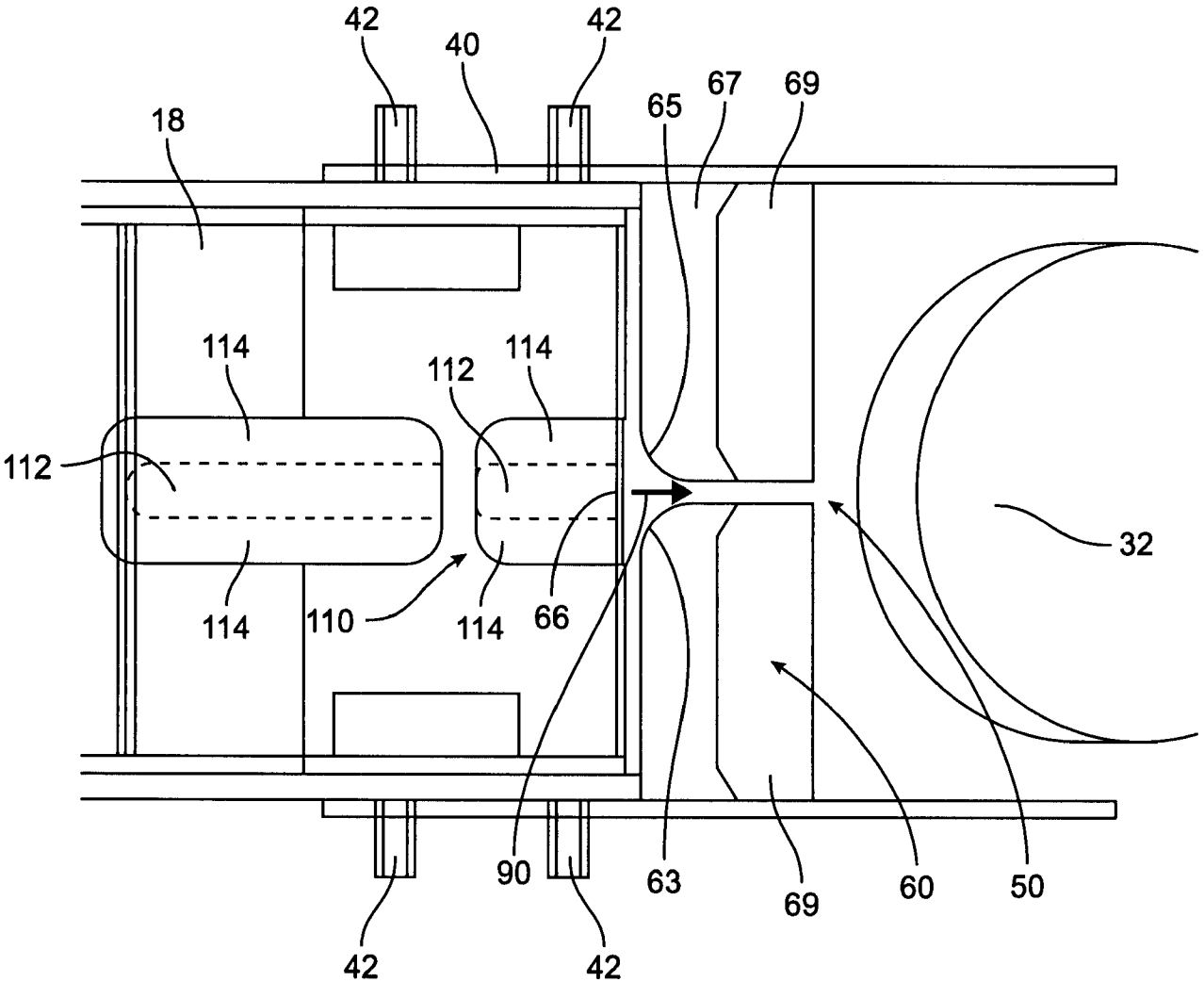
FIGS. 8-9 are a front perspective view and a detailed view, respectively, of a multiflow gassing system, enlarged at the Venturi device, in accordance with one embodiment of the present invention.
Figure 9:
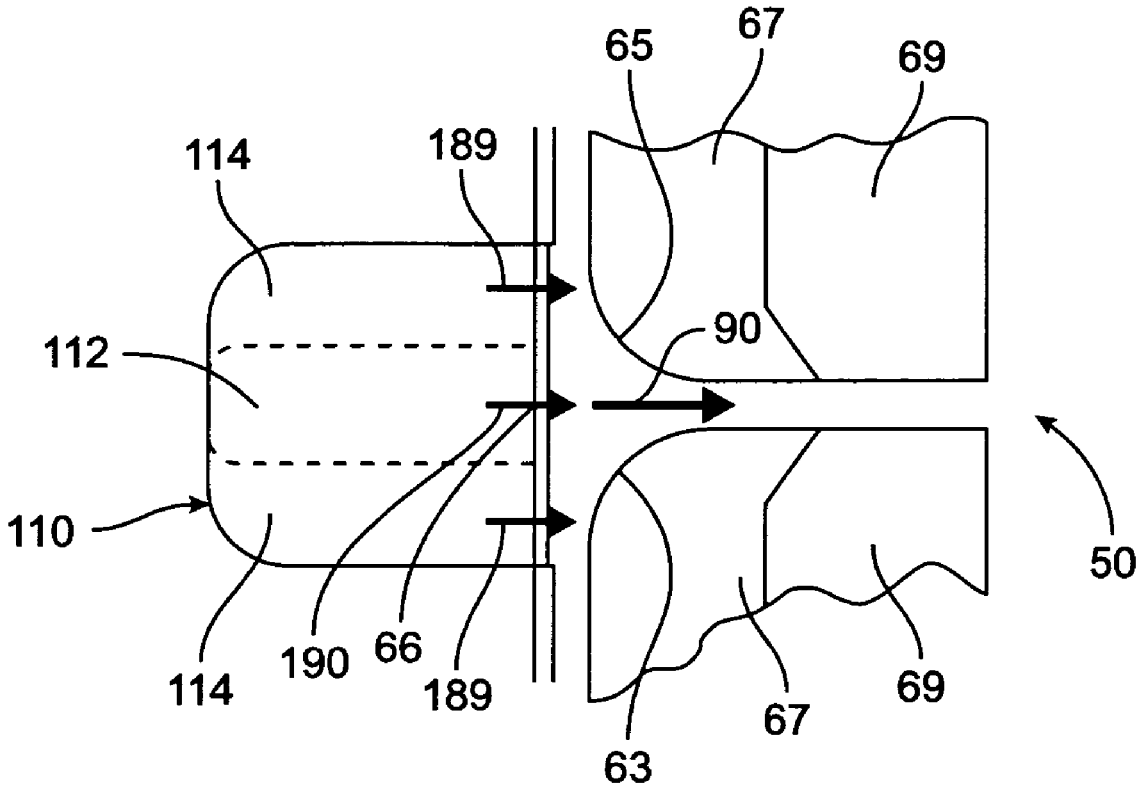

FIGS. 7-9 illustrate directed gas assembly 60 of gas rail assembly 12. Directed gas assembly 60 comprises gas outlet 66, flange portions 40, 41 and plates 62, 64.

Gas outlet 66 comprises an opening 106 through end portion 29 of gas rail housing 18 and a gassing element 110. Gassing element 110 is similar to or the same as gassing elements 25 and 80 described above. Gassing element 110 may comprise a laminar screen, a dual flow laminar screen or a gas manifold as are well known in the art.

In one embodiment, the multiflow gassing system 10 includes a wedge shaped dual laminar flow gassing element that follows the inside contour of the gas rail housing, providing a single element that extends from the top portion 22 to the bottom portion 24 curving around end portion 29. In this example, the dual laminar flow gassing element 110 comprises a multi-ply screen gassing element. In one embodiment, gassing element 110 includes a two-ply high velocity gassing region 112 surrounded by a lower velocity seven-ply gassing region 114. In one embodiment, gas elements 25, 80 and 110 are multi-ply dual laminar flow gassing elements having a high velocity region surrounded by a lower velocity region as are well known in the art. In another embodiment, the gas elements 25, 80 and 110 are single-ply or multi-ply single laminar flow gassing elements having a single velocity region. In one example, the multi-ply gassing elements have from three to five plies. Those skilled in the art will appreciate that the number of plies in the gassing element can affect the radius of curvature that is possible at the end portion 29 where the top portion 22 curves around end portion 29 to the bottom portion 24.

Gas outlet 66 directs a stream of controlled environment gas in a direction indicated by arrow 90 through high velocity region 112. Gas outlet 66 directs a stream of controlled environment gas forward onto an underside of lid 32 and along the top of container 72 at the lid-container engagement region 50. Lid-container engagement region 50 is the area where lid 32 moves off its carrier 30 to be joined to container 72 traveling along the conveyer 94.

End portion 29 of gas rail housing 18 may also include openings 116 located on either side of opening 106. Openings 116 provide a gas outlet for controlled environment gas exiting plenum. Low velocity gassing region 114 of gassing element 110 spans the end portion of gas rail housing 18. Low velocity gassing region 114 provides a blanket of controlled environment gas that flows from plenum through gassing region 114 and out opening 116 in a direction indicated by arrow 86. In another embodiment, end region 29 includes a single opening to allow passage of controlled environment gas from plenum. In this embodiment, controlled environment gas exiting gas element 110 includes both a region of high velocity gas and a region of lower velocity gas. The flow of controlled environment air out gassing element 110 will be discussed in more detail below.

Flange portions 40, 41 are attached to sides 26, 28, respectively, of gas rail housing 18. Flange portions 40, 41 are constructed of a rigid material such as nylon, steel, plastic or the like. Flange portions 40, 41 may be fixedly or adjustably attached to sides 26, 28, of gas rail housing 18. In one embodiment, flange portions 40, 41 are attached to the sides of gas rail housing 18 via flange fasteners 42. In one example, flange fasteners 42 comprise bolts secured to flange portions 40, 41. Adjusting the tightness of the bolts allows for selective positioning of flange portions 40, 41. In another example, flange fasteners 42 comprise adjustment knobs that are selectively tightened to adjust the position of flange portions 40. In one embodiment, flange portions 40, 41 also serve as a base support for lid carrier 30.

First plate 62 and second plate 64 are attached to flange portions 40, 41, respectively. Plates 62, 64 may be the same or similar materials as those used for flanges 40, 41. Plates 62, 64 may be attached to flanges 40, 41 by, for example, welding or adhesive. First and second plates 62, 64 are in a spaced apart configuration. The spacing between the plates 62, 64 forms a narrow channel 104 through which a directed stream of controlled environment gas travels, discussed in more detail below. The width of channel 104 may be adjusted by adjusting flanges 40, 41.

First plate 62 has a curved radiused region 63 adjacent gas outlet 66. Second plate 64 has a similar radiused region 65. In one example, radiused regions 63, 65 are adjacent to the end portion 29 of gas rail housing 18, but are not in direct physical contact with it. In another example, radiused regions 63, 65 are in direct physical contact with the end portion 29 of gas rail housing 18.

Radiused regions 63, 65 form a curved entrance into channel 104 in the shape of a funnel, the funnel having a larger width near gas outlet 66 and an increasingly smaller width at the end of the curved regions 63, 65. Radiused regions 63, 65 funnel the controlled environment gas exiting high velocity gassing region 112 of gassing element 110 into channel 104.

In one example, the curved regions 63, 65 have a radius of 1.0 inch. In another example, the radius of radiused regions 63, 65 is in a range from 0.1 inches to 10.0 inches, such as from 0.05 to 1.0 inches. This curved radiused shape forms a constriction in the channel formed between the spaced apart plates 62, 64 causing a Venturi effect on a stream of gas flowing out of high velocity gassing region 112 of gassing element 110. A Venturi effect as defined herein occurs when a higher velocity flow entrains a lower velocity flow. Controlled environment gas passing through a smoothly varying constriction experience changes in velocity and pressure. Therefore, controlled environment gas exiting gassing element 110 will have an increase in velocity as it passes through and exits channel 104.

The size and shape of the constriction may determine the magnitude of the Venturi effect, as well as the flow rate of the gas. Thus, the spacing 104 between first plate 62 and second plate 64 and the radius of curved regions 63, 65, affect the velocity flow of gas into lid 32 and container 72 at the lid-container engagement region 50. In one example, the distance between plates 62, 64 can be adjusted, via fasteners 42 as adjustment knobs, by varying the position of the attached flange portions 40, 41. In another example, the spacing 104 between first plate 62 and second plate 64 is non-adjustable. In another example, the fasteners 42 as adjustment knobs can be used to adjust the position of the plates 62, 64 relative to the gas rail assembly 12.

In one embodiment, plates 62, 64 also include a horizontally oriented portion 67 and an angled portion 69. In combination, the horizontal portion 67 and angled portion 69 direct the controlled environment gas from openings 116 into open container 72 as container 72 passes below gas rail assembly 12. Gas exiting opening 116 flows in the direction represented by arrow 86. The controlled environment gas passing plates 62, 64 has a lower velocity and creates an inert gas blanket surrounding the higher velocity gas exiting channel 104. This inert gas blanket surrounding the higher velocity gas, protects the higher velocity from mixing with surrounding air.

In another embodiment, plates 62, 64 are replaced by a Venturi tube in the shape of the curved Venturi entrance channel formed by plates 62, 64 and their respective radiused regions 63, 65. The Venturi tube emulates the shape and size of the radiused Venturi channel created by plates 62, 64. In one example, the Venturi tube can be open at the top, bottom, and front and thus only frame the channel on its sides. In another example, the tube can be closed on all sides except for the front, so that gas only exits the tube at the front portion. The Venturi tube can be directly attached to gas outlet 66 via fasteners or an adhesive, and provides the same function as plates 62, 64.

Referring to FIG. 9, in this example the high velocity region 112 of gassing element 110 provides a high velocity stream 190 and the lower velocity regions 114 of gassing element 110 provide low velocity streams 189. In one embodiment, the high velocity stream 190 and the low velocity streams 189 are parallel. Typically, the high velocity stream 190 is designed to have a higher velocity than the low velocity streams 189. This can be accomplished with the use of dual laminar material in the gassing element 110 and inclusion of a hole or thinner, less restrictive portion at the center of the gas outlet 66.

Although the present invention is not to be limited by theory, the gas flow to the lid-engagement region 50 makes use of the Venturi and Coanda principles. Applying the Venturi principle, the radius of curved regions 63, 65 and the spacing of the plates 62, 64 forming the channel 104 as a Venturi device between the plates 62, 64 accelerates the high velocity stream 190 from gas outlet 66. As defined herein, a Venturi device is any device having a channel, gap or tube which permits higher velocity gas flow past the plate. The accelerated stream helps drive a stream of gas to the lid-engagement region 50. Even when the plates 62, 64 are so thin that the Venturi effect is not well developed, the flow velocity is higher along the channel 104 than over the plates 62, 64, because the flow along the channel 104 is not subject to drag from the plates 62, 64. Applying the Coanda principle, the convex shape of the plates 62, 64 have a horizontal portion 67 and angled portion 69 as a Coanda device. As defined herein, a Coanda device is any device where gas flowing by the device follows the shape of the device. The gas stream across the plates 62, 64 follows the convex surface of the plates 62, 64 downward toward the lid-engagement region 50. The plates 62, 64 also help hold the controlled environment gas in the container 72 as the container 72 passes beneath the plates 62, 64 to the lid-engagement region 50.

Those skilled in the art will appreciate that the plates 62, 64 can have different shapes and orientations as suited for a particular application. In one embodiment, the plates 62, 64 are a single plate with no channel. In another embodiment, the plates 62, 64 are straight. In yet another embodiment, the plates 62, 64 are concave. In other embodiments, the plates 62, 64 are angled, with a distinct change of direction in the plate, or free-form, with a combination of one or more of convex, concave, straight, and angled portions. The orientation of the plates 62, 64 can be directed down, up, or straight relative to the planes of the lid carrier 30 and the bottom portion 24. The orientation of the plates 62, 64 can be selected to allow for relative densities of the controlled environment gas versus the surrounding environment. For example, when the controlled environment gas is heavier than the surrounding environment, orienting the plates 62, 64 up allows the controlled environment gas to flow down into the lid-container engagement region 50.

Figure 10:
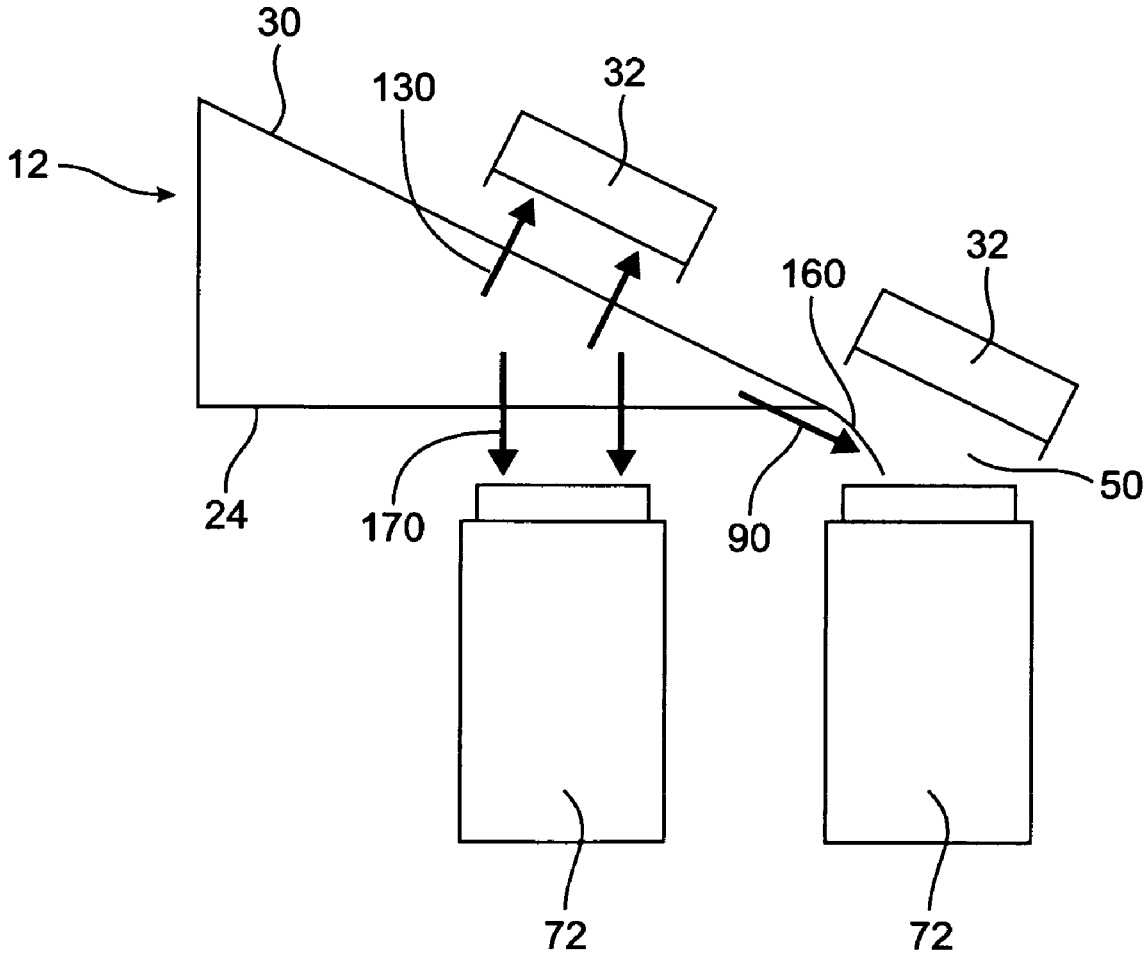
FIG. 10 is a schematic diagram of the multiwedge gassing system in accordance with one embodiment of the present invention.

FIG. 10 is a schematic diagram of the multiflow gassing system in accordance with one embodiment of the present invention. The lid 32 travels along the lid carrier 30 and receives lid gas flow 130 in the open bottom of the lid 32. The container 72 travels along the bottom portion 24 of gas rail assembly 12 and receives container gas flow 170 in the open top of the container 72. The gas outlet flow 90 passing the plate 160 maintains the controlled environment gas at the lid-container engagement region 50. The plate 160 can be directed down, up, or straight relative to the planes of the lid carrier 30 and the bottom portion 24. The shape of the plate 160 can be convex, concave, or straight. The plate 160 can be a single plate or a number of plates.

Referring to FIGS. 1-10, in operation lid 32 moves along lid carrier 30 towards lid-container engagement region 50 adjacent the end 43 of lid carrier 30. As lid travels along lid carrier 30 controlled environment gas exiting plenum through gas element 25 replaces ambient air surrounding at least the underneath side of lid 32. At approximately the same time, container 72 moves along container conveyer 94 towards the lid-container engagement region 50. Controlled environment gas exiting plenum through gas element 80 replaces ambient air within container 72 as well as surrounding container 72.

Upon reaching end 43 of lid carrier 30, lid 32 passes above the horizontal portion 67 of plates 62, 64 and then above the angled portion 69 of plates 62, 64 towards lid-container engagement region 50, where it is joined with container 72. While lid 32 passes along the angled portion 69 of Venturi plates 62, 64, gas from gas elements 110 passing through openings 106 and 116 reaches and gasses the underneath side of lid 32. Thus, both lid 32 and container 72 are in continuous gassing as they move along lid carrier 30 and container conveyer 94, respectively, toward the lid-container engagement area 50.

In the lid-container engagement area 50, lid 32 is positioned above plates 62, 64 and container 72 is positioned below plates 62, 64 and both are gassed through the directed gas assembly 60. The inert gas blanket covers the bottom of lid 32 as well as the top of container 72 at the lid-container engagement region 50 and prevents inflow of air into lid 32 and container 72. The controlled environment around lid 32 is thus maintained all the way until lid 32 is placed on container 72. The lid 32 can be sealed on container 72 in the lid-container engagement region 50 or after leaving the lid-container engagement region 50. In one embodiment, the controlled environment is maintained around the lid 32 and container 72 from the lid-container engagement region 50 until the lid 32 and container 72 are sealed.

In one embodiment, as container 72 moves along conveyer 94, container 72 catches lid 32 along its front portion as container 72 passes underneath lid 32 in the lid-container engagement region 50. As container 72 continues traveling along conveyer 94, the caught lid 32 is pulled off lid carrier 30 and is brought to rest on top of container 72. Lid 32 then travels with container 72 to a lid-container joining apparatus, (not shown) where lid 32 is tightened onto container 72.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A system for providing controlled environment gas to a lid and container, comprising:

a lid carrier;

a gas rail assembly adjacent the lid carrier, the gas rail assembly having a top portion including a top portion gas outlet and an end portion including a end portion gas outlet; and a plate adjacent the end portion;

wherein the top portion gas outlet is oriented to direct the controlled environment gas into the lid and the end portion gas outlet is oriented to direct the controlled environment gas into a lid-container engagement region;

the plate comprises a pair of opposed plates with a channel between the pair of opposed plates; and each plate of the pair of opposed plates includes a radiused region adjacent the end portion.

2. The system of claim 1 wherein the plate forms a Coanda device.

3. The system of claim 1 wherein a shape of the plate is selected from the group consisting of convex, concave, straight, angled, and free-form.

4. The system of claim 1 wherein the radiused region has a radius of 0.05 to 1.0 inches.

5. The system of claim 1 wherein the plate has a horizontally oriented portion and an angled portion.

6. The system of claim 1 wherein the plate has a flange portion operably attached to the gas rail assembly.

7. The system of claim 6 further comprising adjustment knobs adjustably connecting the flange portion to the gas rail assembly for positioning the pair of opposed plates relative to one of the gas rail assembly and each other.

8. The system of claim 1 wherein the gas rail assembly has a bottom portion having a bottom portion gas outlet oriented to direct the controlled environment gas into the container.

9. The system of claim 8 further comprising a conveyer positioned to move the container along the bottom portion.

10. The system of claim 8 wherein the top portion and the bottom portion are positioned at an angle.

11. The system of claim 1 wherein the gas rail assembly includes a wedge shaped plenum.

12. The system of claim 1 wherein the end portion gas outlet has a laminar screen with at least one opening therein.

13. The system of claim 1 wherein the end portion gas outlet has a gassing element selected from the group consisting of a laminar screen, a dual flow laminar screen, and a gas manifold.

14. A system for providing controlled environment gas to a lid and container, the system comprising:

means for flowing the controlled environment gas into a lid passing along a lid carrier; and means for flowing the controlled environment gas past a plate into a lid-container engagement region;

wherein the means for flowing the controlled environment gas past a plate into a lid-container engagement region comprises means for flowing the controlled environment gas through a Venturi device into the lid-container engagement region, the Venturi device being a channel with a radiused region in the plate.

15. The system of claim 14 further comprising means for simultaneously flowing the controlled environment gas into the container.

16. The system of claim 14 further comprising means for conveying the container into the lid-container engagement region.

17. The system of claim 14 further comprising means for adjusting flow velocity through the Venturi device.

18. A system for providing controlled environment gas to a lid and container, comprising:

a lid carrier;

a gas rail assembly adjacent the lid carrier, the gas rail assembly having a top portion including a top portion gas outlet and an end portion including a end portion gas outlet; and a plate adjacent the end portion;

wherein the top portion gas outlet is oriented to direct the controlled environment gas into the lid and the end portion gas outlet is oriented to direct the controlled environment gas into a lid-container engagement region;

the plate comprises a pair of opposed plates with a channel between the pair of opposed plates; and the pair of opposed plates forms a Venturi device.

19. A system for providing controlled environment gas to a lid and container, comprising:

a lid carrier;

a gas rail assembly adjacent the lid carrier, the gas rail assembly having a top portion including a top portion gas outlet and an end portion including a end portion gas outlet;

a Venturi tube adjacent the end portion, the Venturi tube being a tube with a radiused region; and wherein the top portion gas outlet is oriented to direct the controlled environment gas into the lid and the end portion gas outlet is oriented to direct the controlled environment gas into a lid-container engagement region.

20. A system for providing controlled environment gas to a lid and container, the system comprising:

means for flowing the controlled environment gas into a lid passing along a lid carrier; and means for flowing the controlled environment gas past a plate into a lid-container engagement region;

wherein the means for flowing the controlled environment gas past a plate into a lid-container engagement region comprises means for flowing the controlled environment gas over a Coanda device into the lid-container engagement region, the Coanda device being a curved surface of the plate.

* * * * *